United States Patent [19]

Musschoot et al.

[11] Patent Number: 4,662,425

[45] Date of Patent: May 5, 1987

[54] VIBRATORY PART SCRUBBER AND METHOD

[75] Inventors: Albert Musschoot; Robert Bond, both of Barrington, Ill.

[73] Assignee: General Kinematics Corporation, Barrington, Ill.

[21] Appl. No.: 864,757

[22] Filed: May 14, 1986

Related U.S. Application Data

[63] Continuation of Ser. No. 748,132, Jun. 24, 1985, abandoned, which is a continuation of Ser. No. 549,827, Nov. 9, 1983, abandoned.

[51] Int. Cl.[4] ..... B22D 29/00

[52] U.S. Cl. ..... 164/131; 164/260; 164/344; 164/345; 164/404; 51/21; 134/7

[58] Field of Search ..... 164/69.1, 131, 132, 164/260, 344–346, 404; 51/7, 17, 21, 313, 317; 134/7, 8

[56] References Cited

U.S. PATENT DOCUMENTS

| | | | |
|---|---|---|---|
| 3,128,577 | 4/1964 | Guibert et al. | 51/7 |
| 3,358,815 | 12/1967 | Musschoot et al. | 198/220 |
| 3,581,440 | 6/1971 | McKinney et al. | 51/7 |

FOREIGN PATENT DOCUMENTS

| | | | |
|---|---|---|---|
| 0799940 | 1/1981 | U.S.S.R. | 51/7 |

*Primary Examiner*—Nicholas P. Godici
*Assistant Examiner*—Richard K. Seidel
*Attorney, Agent, or Firm*—Wood, Dalton, Phillips, Mason & Rowe

[57] ABSTRACT

An apparatus usable for cleaning foreign material from the internal and external surfaces of a part, including a container of particulate media, a vibration generator for the container which creates an amplitude and frequency which will fluidize the media, and means for suspending the part in the fluidized media. The suspending means is vibrated at an amplitude and frequency different from the amplitude and frequency of the container whereby the fluidized media will clean the foreign material from the internal and external surfaces of the part.

8 Claims, 5 Drawing Figures

42
74
70
72
44
64
62
60
66
48
46
52
10
14
53
50
54
3.
82
84
12
16
18
20
22
24
26
30
34
36
38
40

VIBRATORY PART SCRUBBER AND METHOD

This application is a continuation of application Ser. No. 748,132, filed June 24, 1985, now abandoned, which is a File Wrapper Continuation of Ser. No. 549,827, filed Nov. 9, 1983, now abandoned.

BACKGROUND OF THE INVENTION

1. Technical Field

The present invention relates to a method and apparatus for scrubbing foreign material from internal and external surfaces of a part such as a casting.

2. Background Art

In many manufacturing and assembly processes foreign material may be adhered to or deposited on the internal and external surfaces of the part being manufactured. The foreign material must be removed before the part is put into an assembly or into use.

A specific example of the general problems is in the casting industry wherein a variety of metal casting processes are used, with one such process involving the use of inexpensive styrofoam patterns which have been coated with a ceramic-type material. The patterns can be formed with intricate shapes having depressions, cavities, internal passages, crevices, chambers and the like. The pattern is positioned in a mold box and sand is formed therearound ready for casting. During the casting process, the styrofoam pattern melts away while the ceramic-type coating holds its shape long enough to form the metal casting. The ceramic type coating however also breaks up during the process and in doing so leaves particles of coating of foreign material or of sand adhered to the internal and external surfaces of the casting. Such particles or foreign material are, of course, undesirable in the finished product, and thus it is desirable to remove those particles. However, inasmuch as many castings will have internal passages, hole, crevices, chambers and the like which are hard to reach, the removal of those particles is difficult.

All molding systems suffer, in varying degrees, the same shortcomings namely, leaving residual particles or foreign material of the pattern and the molding sand on the external surfaces and in the internal surfaces of the castings. The residual particles need to be purged from the casting before the casting is processed further and/or put into use.

The present invention is directed toward overcoming one or more of the problems as set forth above.

SUMMARY OF THE INVENTION

In one aspect of the present invention, an apparatus is provided which is usable for cleaning parts such as metal castings and in particular for cleaning particles or foreign material from the surface and from the cavities of a part, the apparatus including a container of particulate media, a vibration generator for the container, the generator creating a vibratory motion which will fluidize the media, and means for suspending the part in the fluidized media. The suspending means is also vibrated with a vibratory motion different from the vibratory motion of the container vibration generator so as to provide the part with a vibratory motion.

In another aspect of the present invention, a method is disclosed for cleaning out particles or foreign material from the cavities of a part, the method including the steps of vibrating a mass of particulate media with a vibratory motion which will fluidize the media, and locating the part in the media so that the media will flow around the casting and into any cavities in the casting and abrasively remove any particles or foreign material.

With the present invention, a part such as a casting may be easily and inexpensively scrubbed to clean its internal and external surfaces as is desirable and often necessary.

DESCRIPTION OF THE PREFERRED EMBODIMENTS

Figures 1, 2:
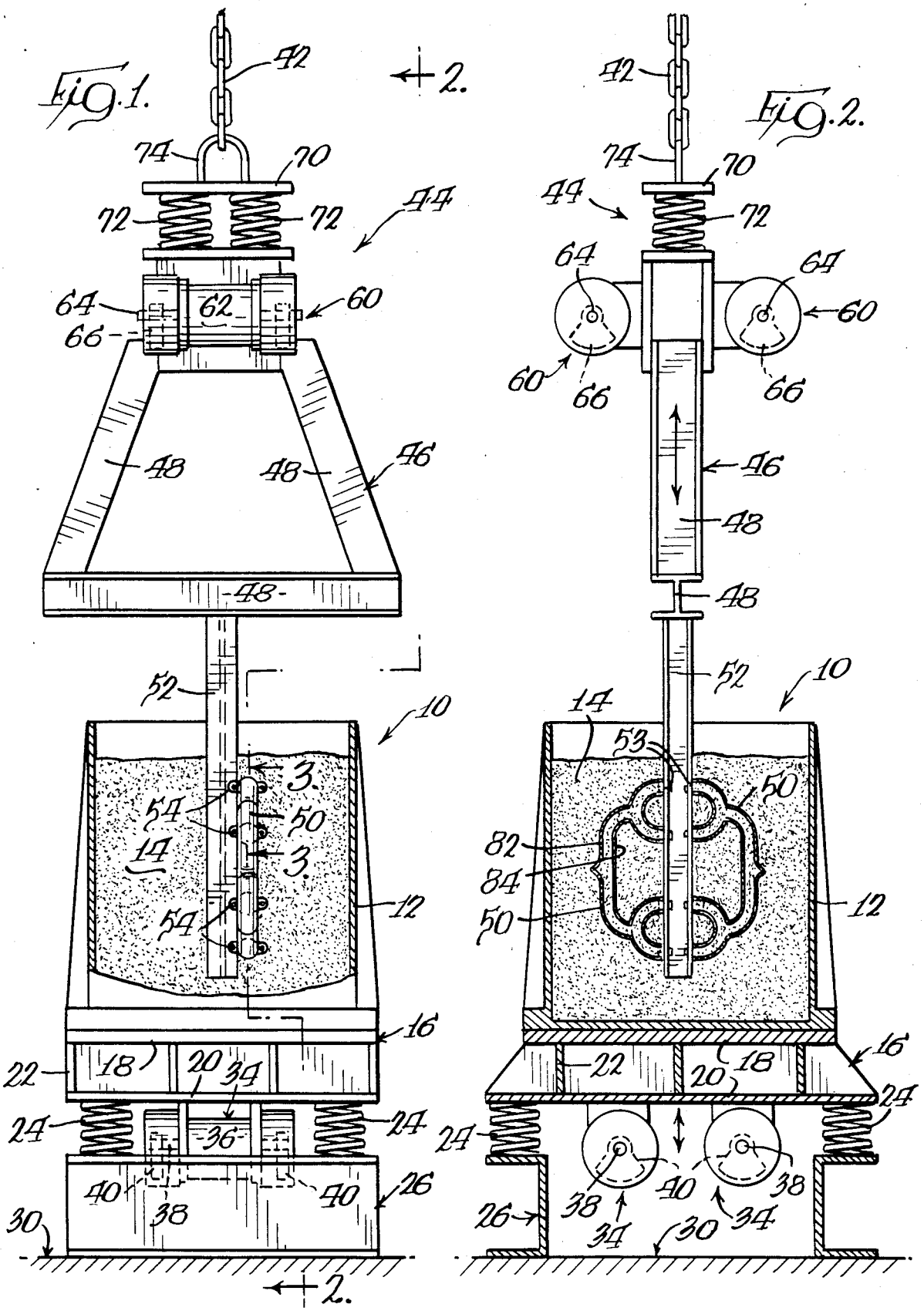
FIG. 1 is a partial cross-sectional view of a first embodiment of the vibratory scrubber.
FIG. 2 is a view taken along line 2—2 of FIG. 1.

A vibratory scrubber 10 which is shown specifically as scrubbing a casting and in one embodiment of the present invention is shown in FIGS. 1 and 2. The scrubber 10 includes a container 12 for particulate scrubbing media 14, such as steel shot, mixture of liquid and solids or any other fluidized material, and the container 12 is fixed to a platform 16. Due to the weight of the container 12 and media 14, it is necessary to have a suitably reinforced platform 16, as for example by connecting spaced plates 18,20 with a bracing structure 22.

The platform 16 is mounted on four corners to springs 24 which are themselves mounted on a base 26 suitably secured to the floor 30.

Vibration generators 34 of any well known type is provided with the vibration generator shown being in the form of electric motors 36 having shafts 38 carrying eccentric weights 40. The generators are suspended from the bottom of the platform 16 in order to produce the vibrations. The vibration generators 34 may be of the type shown in U.S. Pat. No. 3,358,815 where the effective force of the eccentric weights may be varied from zero to maximum and thus produce a variation in stroke as desired. Other types of vibration generators could be substituted for the eccentric vibration generators 34, such as hydraulic vibrators and the like.

The vibration generators 34 are energized to produce a vibratory motion for the container 12 and its contents in excess of the acceleration due to gravity. The acceleration in g's can be calculated by the formula $$\text{Acceleration} = \frac{S \times F^2}{70400}$$

where S is the amplitude of the stroke in inches and F is the frequency of the stroke in strokes per minute. For example, with a frequency of 3600 strokes per minute and a stroke amplitude of 0.007 inches, there is produced an acceleration of 1.29 g's on the container 12 and the media 14. This acceleration causes the media 14 to become fluidized, and thereby to flow freely.

Suspended by a chain 42 above the container 12 is a part or casting supporting structure 44 comprised of a frame 46, made of I-beams 48, having sufficient rigidity to support and vibrate a part or casting 50. A mounting beam 52 depends vertically downward from the frame 46 and is adaptable for mounting a desired number and type of part or casting 50. In the embodiment shown, two castings 50,50 are fixed to the mounting beam 52 by bolting flanges 54 of the castings 50 onto the mounting beam 52. Of course, other means of fixing the parts or castings 50 shown, as well as other types of parts or castings, to the mounting beam 52 would be suitable and apparent to those skilled in the art. It is important that the openings 53 into the passageways 55 be kept open and unobstructed so that the media 14 can flow freely into and out of the passageways.

The frame 46 is directly connected to a second set of vibration generators 60, each of which in the illustrated form also comprises an electric motor 62 driving a shaft 64 having synchronized eccentric weights 66 on both ends. As with the vibration generators 34 of the container 12, it is desirable to drive the second set of vibration generators so that the frame is vibrated in a manner in which the $$\text{Acceleration} = \frac{S \times F^2}{70400}$$

is greater than one.

The second set of vibration generators 60 are suspended from an upper plate 70 by a pair of springs 72. The upper plate 70 has a bracket 74 which is connected to the supporting chain 42. The upper plate 70 is isolated from the vibrations of the vibration generators 60 by the springs 72. Suitable means are provided to manipulate the chain 42 so as to lower the frame 46 and mounting beam 52 to locate the castings 50 in the media 14, and also to raise the frame 46 from the media ready for removal of the castings or parts 50.

Figure 3:
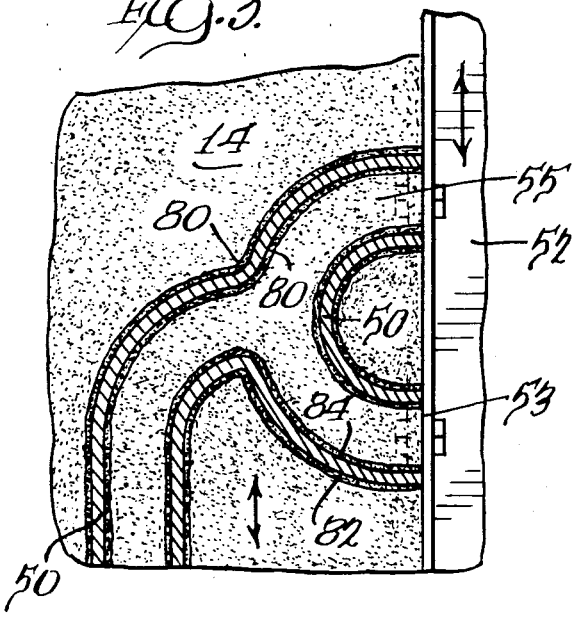
FIG. 3 is a partial enlarged cross-sectional view taken along line 3—3 of FIG. 1.

Castings or parts 50 may be manufactured using styrofoam patterns which have been coated with a ceramic-type material. During the casting process, the styrofoam pattern is essentially melted away and the ceramic-type coating holds its shape long enough to form the casting 50 but then breaks up as well. This process leaves particles of foreign material 80 (see FIG. 3) of the coating as well as other materials adhered to the external surfaces 82 and internal surface 84 of the casting 50. The scrubber 10 is used to remove these particles or foreign material 80 from all surfaces both external 82 and internal 84 of the casting 50.

Figure 4:
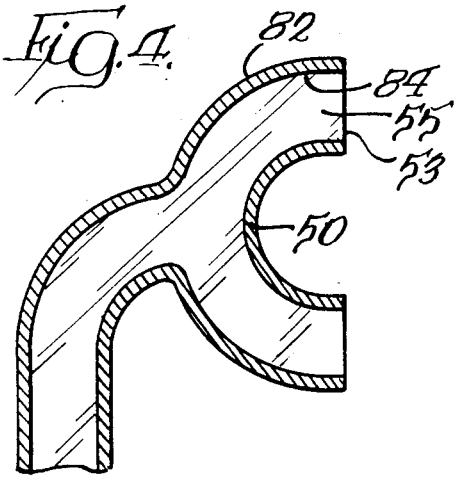
FIG. 4 is a cross-sectional view of a portion of the casting of FIG. 3 after scrubbing by the scrubber.

To remove the particles or foreign material 80, the castings or parts 50 are fixed to the mounting beam 52 and then the vibration generator 34 for the container 12 and media and the generator 60 for the frame 46 and parts 50 are energized. The vibrating frame 46 is lowered to locate the parts or castings 50 into the vibrating media 14 which is easily accomplished inasmuch as the media 14 in the container 12 is fluidized by the vibrations of the generators 34. The media 14 thus easily flows about the casting 50 and into crevices and passageways in the casting 50, and the vibration of the casting 50 itself ensures that the media 14 will flow freely into any such crevices and passageways in the casting 50 as well. The flow of the media 14 about the external surfaces 82 and through the passageways over the internal surfaces 84 in the castings 50 is abrasive on the surfaces of the castings 50 and thus the particles or foreign materials 80 are scrubbed clean from the parts or castings. The result is a clean and, with certain types of materials, shiny casting 50 as shown in FIG. 4.

The vibration generators 60 on the supporting structure 44 may continue to be driven as the structure 44 is raised to remove the part or casting 50 from the container 12 so as to discharge the media and freed foreign material or particles 80 from the pasageways 55 in the parts or castings.

Figure 5:
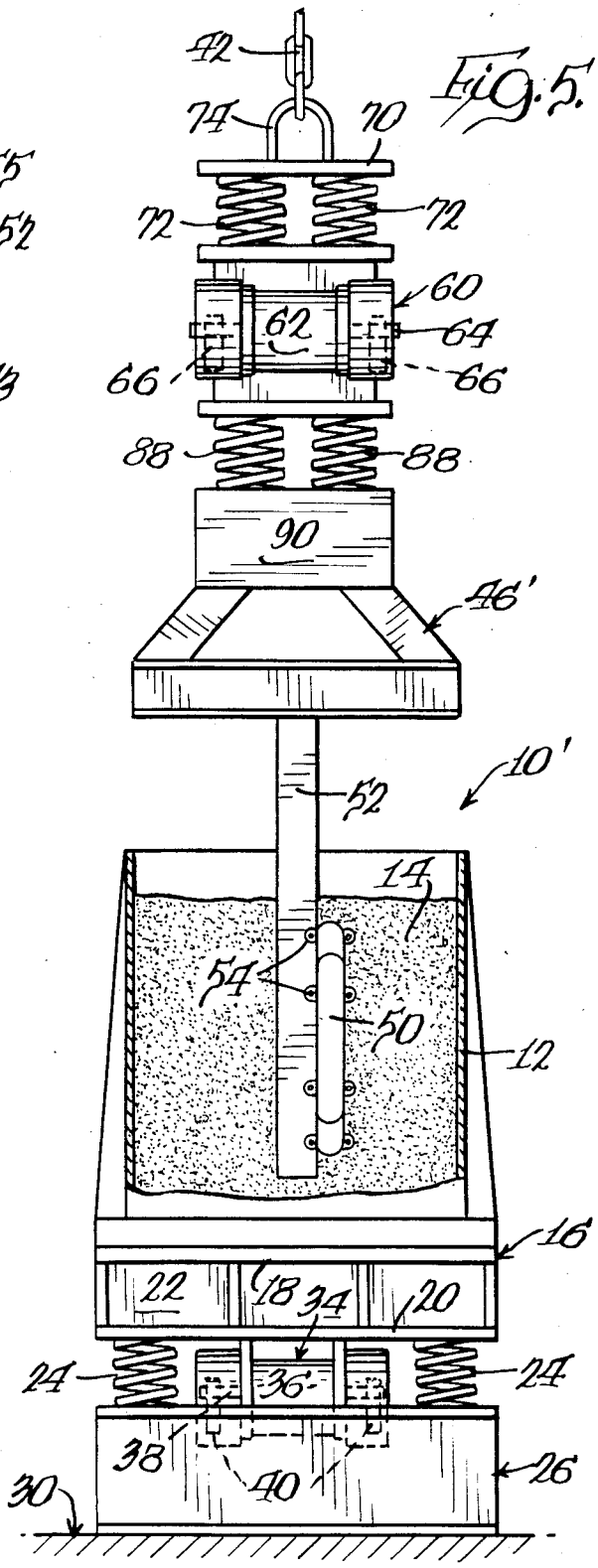
FIG. 5 is a partial cross-sectional view similar to FIG. 1 of an alternative embodiment of the vibratory scrubber.

An alternative embodiment of the vibratory scrubber 10' is shown in FIG. 5. The same reference numerals are used for the members that are identical to FIG. 1. This scrubber 10' uses a two mass system for vibrating the part or casting 50. With the scrubber of FIG. 5, the set of vibration generators 60 used to apply a vibratory motion to the frame 52 and part 50 are not directly attached to the frame 46', but rather are attached to a second set of springs 88 extending between the first set of vibration generators 60 and a working weight 90 carried by the frame 46' and mounting beam 52. The second set of springs 88 are used to tune the vibrations of the frame 46 for enhancing the vibratory motion of the part or casting 50.

Other aspects, objects and advantages of the present invention can be obtained from a study of the drawings, the specification and the appended claims.

What is claimed is:

1. A method for scrubbing particles from internal and external surfaces of a casting, comprising the steps of:

vibrating a mass of media substantially in a vertical direction through a first vibration imparting means with a frequency and amplitude that will fluidize the media;

vibrating the casting substantially in a vertical direction through a second vibration imparting means, said first and second vibration imparting means vibrating so that both the media and casting are vibrated at a vertical stroke of S inches and a frequency of F strokes per minute such that $SF^2/70400 > 1$;

locating the vibrating casting in the fluidized media, whereby the media will flow into and around the internal and external surfaces and scrub particles from the surface of the cavities; and raising the casting vertically out of the media as the casting is vibrating to discharge the media and freed particles.

2. The method of claim 1 wherein $$\frac{S\,F^2}{70400}$$

is substantially equal to 1.3.

3. An apparatus usable for scrubbing particles from the internal and external surfaces of a casting, comprising:

a container of media;

means for fluidizing the media in the container by vibrating the media substantially in a vertical direction;

means for suspending the casting in the fluidized media;

means for vibrating the casting in the fluidized media substantially in a vertical direction whereby particles will be scrubbed from the internal and external surfaces of the casting, said means for fluidizing the media and said vibrating means each having a stroke of S inches and a frequency of F strokes per minute and $SF^2/70400$ is greater than 1; and means for removing the casting vertically upwardly from the media in the container with the media fluidized to discharge the media and freed particles.

4. The apparatus of claim 3 wherein the means for vibrating the casting vibrates the casting at a frequency and amplitude that varies from a frequency and amplitude applied to the media by the means for fluidizing the media.

5. The apparatus of claim 3, wherein said means for suspending the casting comprises:

a frame;

means for mounting the casting on the frame;

said means for vibrating the casting being mounted on the frame; and means for raising and lowering the frame and vibrating means to move the mounted casting into and out of the fluidized media.

6. A method for scrubbing particles from internal and external surfaces of a casting, comprising the steps of:

vibrating a mass of media substantially in a vertical direction through a first vibration imparting means with a frequency and amplitude that will fluidize the media;

vibrating the casting substantially in a vertical direction through a second vibration imparting means, said first vibration imparting means vibrating so that the media is vibrated at a vertical stroke of S inches and a frequency of F strokes per minute such that $$\frac{S F^2}{70400} > 1;$$

locating the vibrating casting in the fluidized media, whereby the media will flow into and around the internal and external surfaces and scrub particles from the surface of the cavities; and raising the casting vertically out of the media as the casting is vibrating to discharge the media and freed particles.

7. An apparatus usable for scrubbing particles from the internal and external surfaces of a casting, comprising:

a container of media;

means for fluidizing the media in the container by vibrating the media substantially in a vertical direction;

means for suspending the casting in the fluidized media;

means for vibrating the casting in the fluidized media substantially in a vertical direction whereby particles will be scrubbed from the internal and external surfaces of the casting, said means for fluidizing the media having a stroke of S inches and a frequency of F strokes per minute and $$\frac{S F^2}{70400} > 1;$$

means for removing the casting vertically upwardly from the media in the container as the casting is being vibrated and as the media is being fluidized to discharge the media and freed particles from the casting.

8. The apparatus of claim 7, wherein said means for suspending the casting comprises:

a frame;

means for mounting the casting on the frame;

said means for vibrating the casting being mounted on the frame; and means for raising and lowering the frame and vibrating means to move the mounted casting into and out of the fluidized media.

* * * * *